US005449044A

United States Patent [19]

Phillips

[11] Patent Number: 5,449,044

[45] Date of Patent: Sep. 12, 1995

[54] MINIATURE IMPACT TOOL

[76] Inventor: Raymond J. Phillips, 67 Wawecues Hill Rd., Bozrah, Conn. 06334

[21] Appl. No.: 146,442

[22] Filed: Oct. 29, 1993

[51] Int. Cl.[6] ..... B25D 11/10

[52] U.S. Cl. ..... 173/203; 173/205; 173/120

[58] Field of Search ..... 173/203, 205, 120, 47, 173/48; 30/167, 168

[56] References Cited

U.S. PATENT DOCUMENTS 4,030,556 2/1977 Phillips ..... 173/120

*Primary Examiner*—Rinaldi I. Rada

[57] ABSTRACT

A miniature impact tool in which a cam is utilized for moving a striker backward by converting rotary motion of a drive shaft to a linear motion. The striker is in contact with a spring/plunger assembly and is moved away from a surface to be struck during a portion of the rotation cycle of the cam. On further rotation the cam surface is cut away and spring action drives the striker forward, causing impact of a cutting tool (chisel) against a workpiece. Excessive wear of the drive shaft is eliminated using a specific design of a shelf upon which the striker moves, as well as a sleeve bearing around the drive shaft in the area of possible wear. The striker is provided with a guide structure (such as a recess) into which the nose of the plunger fits in order to provide controlled guidance of the striker in its longitudinal movement. The output shaft of the tool accepts removable collets of varying shapes in order to accommodate chisel tools having different shank geometries and sizes.

10 Claims, 4 Drawing Sheets

MINIATURE IMPACT TOOL

FIELD OF THE INVENTION

This invention relates to an improved miniature impact tool of the type which is a hand-held mechanically operated tool for use in engraving and other applications, and more particularly to such a tool in which wear due to mechanical movement of parts therein is minimized.

BACKGROUND ART

My previous U.S. Pat. No. 4,030,556 describes a miniature impact tool that is particularly suited for applications such as engraving, chipping, die making, dental and orthopedic surgery, sculpting, carving, riveting, etc. This is a hand-held impact tool in which rotary motion is converted to linear motion wherein intermittent force is applied to a striker causing it to impact on (contact) a chisel tool held in contact with a workpiece. A drive portion of the miniature tool converts rotary motion to linear motion by means of a cam interface. A spring and plunger arrangement are used to provide the intermittent force which is delivered to a striker that contacts a chisel tool holder. Due to the compressive force of the spring, the striker will provide a sharp blow to the tool holder causing the tool to chip or carve or otherwise impact on the intended workpiece. This cycle is continually repeated as the cam is caused to rotate against a bearing surface connected to the striker.

The entire content of U.S. Pat. No. 4,030,556 is incorporated herein by reference. Pertinent portions thereof will also be reviewed in the description of the preferred embodiments of this invention.

The present invention is based on a recognition of potential wear problems in selective portions of the miniature impact tool of my previous U.S. Pat. No. 4,030,556 . Based on my experimentation and use of this impact tool, I have found that the action of the cam against a needle-bearing at an above-the-centerline point can cause a slight "cocking" of the striker-bearing assembly. This allows the bearing assembly to rise so as to sometimes touch the drive shaft. When repeated for a long period of time, this can provide excessive wear of the drive shaft.

I have also found that the striker tends to move in transverse directions during its longitudinal back and forth movement. These slight departures from movement back and forth along a single longitudinal axis can cause increased friction between the striker and its top and bottom adjoining surfaces, as well as between the striker and its adjoining right and left (side) surfaces. The result is increased friction and less efficiency since not all of the force impacted to the striker by the plunger will then be delivered to the cutting tool.

I have also modified my miniature impact tool by designing the chisel-holding end of the tool to accept a collet, where the collet can have different shapes so as to accept chisels of different cross sectional shapes including round, rectangular, and square shapes.

Accordingly, it is a primary object of this invention to provide an improved miniature impact tool of the general type described in my previous U.S. Pat. No. 4,030,566 where reduced weal and increased efficiency results.

It is another object of this invention to provide an improved tool of the general type described in my previous U.S. Pat. No. 4,030,556 in which chisel tools of varying shape can be easily accepted and wherein increased tool efficiency results.

It is another object of this invention to provide an improved tool of the type described in my previous U.S. Pat. No. 4,030,556 in which the features of compactness, light weight, and ability to be hand-held are maintained while providing a more versatile and efficient tool having long life.

SUMMARY OF THE INVENTION

As with my previous miniature impact tool, the present tool converts input rotary motion to lineal motion, where the linear motion is repeatedly applied to a striker causing the striker to move in a first direction against a plunger which is spring-loaded. When the force causing the striker to move in that direction is released, the energy of the spring is rapidly imparted to the striker by virtue of the attached plunger, causing the striker to move forward and strike a sharp blow against the chisel tool. Conversion of the input rotary motion to linear motion is achieved by using a cam interface where a plurality of bearing surfaces are employed to ease the friction associated with the rotary motion.

In the foregoing design, the striker can rise or move slightly upward at its forward end where a cam/needle-bearing assembly is located. In order to prevent this slight "cocking" of the striker and bearing assembly, an extended shelf is used above the striker in order to limit its movement in a vertical direction transverse to the intended back and forth longitudinal movement of the striker. The extended shelf covers most of the top surface area of the striker, having an opening only large enough to allow the needle bearing to move freely back and forth when driven by the cam.

As a further aid to reducing wear on the drive shaft connected to the source of input rotary motion, a sleeve bearing having a running fit to the drive shaft surrounds the drive shaft and prevents any wear due to a rise of the needle bearing against the drive shaft. This complements the action of the extended shelf located over the striker assembly, so that wear on the drive shaft is substantially eliminated.

In order to alleviate the problem wherein the striker can move from side to side as well as up and down when actuated by the spring/plunger assembly, a recess (guide means), such as a generally conical depression, is provided in the rear surface of the striker, i.e., the surface that is contacted by the plunger. The nose of the spring plunger rests in this depression providing alignment of the plunger and striker. This minimizes up and down motion (as well as side-to-side motion) of the striker within the confines of the striker cavity, thereby minimizing friction between the striker and the surrounding surfaces. Because of this, a greater impact will be delivered to the chisel, thereby making the impact tool more efficient.

The chisel-holding end of the tool is modified to allow collets of different types to be inserted into the chisel-holding end. This allows the tool to accept chisels having shanks of different shapes including round, rectangular, square, triangular, etc.

These and other objects, features, and advantages will be apparent from the following detailed description of the preferred embodiments.

BRIEF DESCRIPTION OF THE DRAWINGS

FIG. 10 illustrates a suitable collet, while

DETAILED DESCRIPTION OF THE PREFERRED EMBODIMENTS

Figure 1:
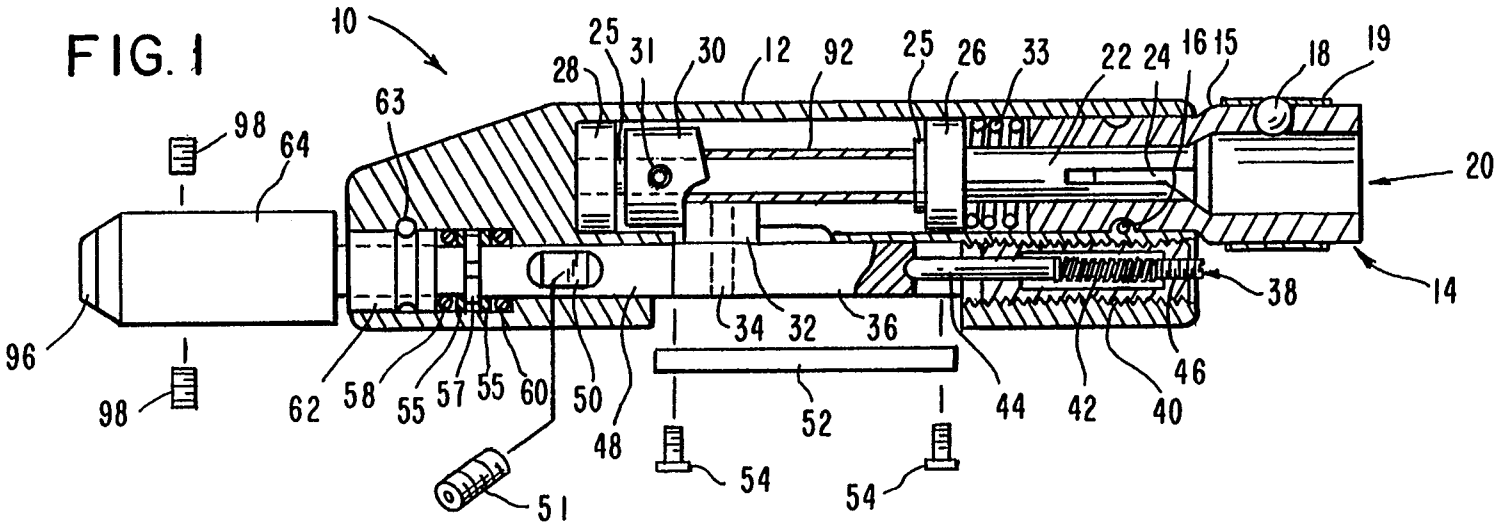
FIG. 1 is a cutaway view of the miniature impact tool of this invention, illustrating the various structural features of the tool.

FIG. 1 is a cut-away view showing the improved miniature impact tool 10 of this invention. The new design is a modification of the structure generally shown in FIG. 1 of U.S. Pat. No. 4,030,556. Tool 10 includes a housing 12 having at its aft end a drive shaft retainer 14 including a flanged portion 15. A rotary drive is inserted into the aperture 20 of flanged portion 15. At the fore end of tool 10 the output shaft 48 includes a flanged cylindrical portion 64 into which a cutting tool or chisel is inserted. The center portion of the tool contains a means Fox converting rotary drive motion into reciprocal horizontal longitudinal motion, in order to cause a striker 36 to impact the output shaft 48 in order to drive the cutting tool or chisel forward.

Drive shaft retainer 14 is held in a fixed position in housing 12 by a spring pin 16. As an alternative, the drive shaft retainer 14 can be threaded for screwing it into housing 12. Aperture 20 is adapted for holding a rotary drive such as a cable (not shown) that is secured to a shaft 22 with a slot 24 for mating with the rotary drive. The means for holding the rotary drive cable is conventionally well known, and includes the ball bearing 18 that is retained in place by the spring band 19. In operation, a small amount of force is used to insert the retaining sleeve of the drive cable into aperture 20, and to remove it therefrom.

Shaft 22 has ball bearing assemblies 26 and 28 thereon wherein bearing 26 is held in place by snap ring 25. Ball bearing assembly 28 is disposed between shaft 22 and the interior wall of housing 12. A cam 30 is affixed to shaft 22 by the retaining spring pin 31. Located between the forward end of drive shaft retainer 14 and the bearing assembly 26 is a spring assembly 33 that is used to bias the cam 30 in the forward direction. As will be appreciated later, because the cam 30 has a particularly shaped surface, and because the cam is biased forwardly by spring assembly 33, the cam 30 and bearing assembly 32 will not be in contact when the striker 36 is impacted forward against the output shaft 48, thereby preventing damage to the bearing assembly 32.

Bearing assembly 32 functions as a cam follower and is affixed to a pin 34. Pin 34 is secured to a striker 36 using a press-fit. A spring plunger assembly 38 is located aft of the striker 36, the spring plunger assembly being used to drive the striker forward during operation of the miniature impact tool. Spring plunger assembly 38 includes a threaded body 40 which is screwed into a portion of housing 12. Within body 40 is a spring 42 connected to the plunger 44. A spring retainer screw 46 located within the body of assembly 38 is used to adjust the tension of spring 42. Additionally, the impact of striker 36 upon output shaft 48 may be increased either by screwing the plunger assembly 38 further inward, or by increasing the tension of the internal spring 42 using spring retainer screw 46.

Output shaft 48 has a flattened portion 50 against which a screw 51 can abut in order to prevent the rotation of shaft 48. Bottom plate 52 is secured to housing 12 using a plurality of screws 54. In contrast with the design of U.S. Pat. No. 4,030,556, two washers 55 and a retaining ring 57 replace the flange used in the design of U.S. Pat. No. 4,030,556. O-rings 58 and 60 are located adjacent to washers 55 and are elastomeric cushioning rings that provide isolation. That is, these O-rings suspend, or float, tool holder shaft 48 longitudinally (i.e., in a direction along the shaft axis) so that maximum impact is transferred from the striker 36 to the tool tip. Retaining ring 57 prevents the washers 55 and O-rings 58, 60 from moving fore and aft during operation of tool 10.

A bushing 62 is secured in place by a cross pin or spring ring 63. Bushing 62 holds the output shaft 48 in place during operation, allowing the shaft 48 to slide within it. The flanged cylindrical portion 64 of output shaft 48 is bored out to accept a collet 96, which in turn is held in place by the collet retaining screw 98.

In operation, a rotary drive unit is affixed to drive shaft 22 through aperture 20, causing shaft 22 and cam 30 to rotate. The rotation of cam 30 places a force against bearing 32 and pin 34, causing the striker 36 and plunger 44 to retract against the spring 42, compressing spring 42. When bearing 32 rides beyond the raised portion of cam 30, the force against bearing 32 is released thereby causing spring 42 to move plunger 44 and striker 36 forward. Striker 36 then hits tool holder 48, delivering a sharp blow. This drives the chisel against the workpiece, causing the cutting action. This cycle is then repeated in order to continue the cutting operation. Thus, this miniature tool is characterized by a drive mechanism that converts a rotary motion to a linear motion through the use of a cam acting on a spring-loaded device.

Figure 2:
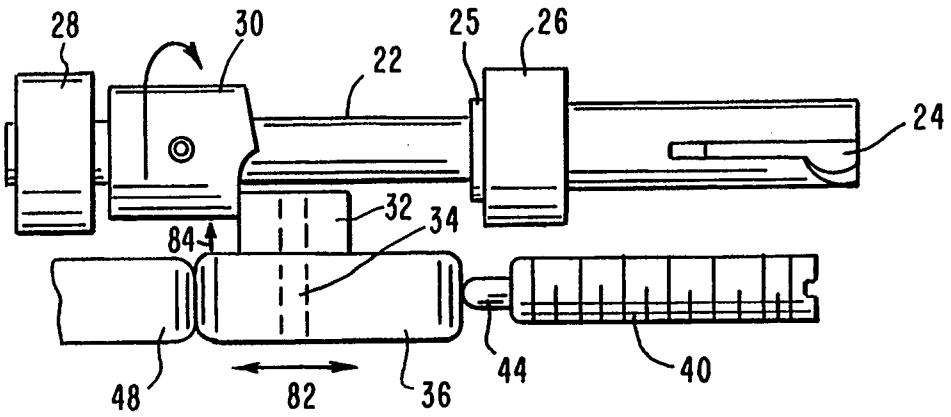
FIG. 2 PRIOR ART
FIG. 2 is a schematic illustration of a portion of the apparatus of U.S. Pat. No. 4,030,556, which is shown in order to illustrate one of the problems sought to be corrected by the present design, namely the slight "cocking" of the striker/bearing assembly.

FIG. 2 is a schematic illustration of the various moving elements of the impact tool of U.S. Pat. No. 4,030,556. Because the striker 36 is not supported along its entire length and because of the clearances necessary for the striker to move back and forth freely (arrow 82), the striker can rise or move slightly upward at its forward or bearing end as illustrated by arrow 84. This can occur during each cycle due to cam 30 acting against the needle bearing 32 at an above-the-centerline point. This slight "cocking" of the striker/bearing assembly allows the needle bearing 32 to rise so as to sometimes touch the drive shaft 22. When this is repeated over many cycles of operation, excessive wear of the drive shaft can occur where it is contacted by the needle bearing.

Figure 3:
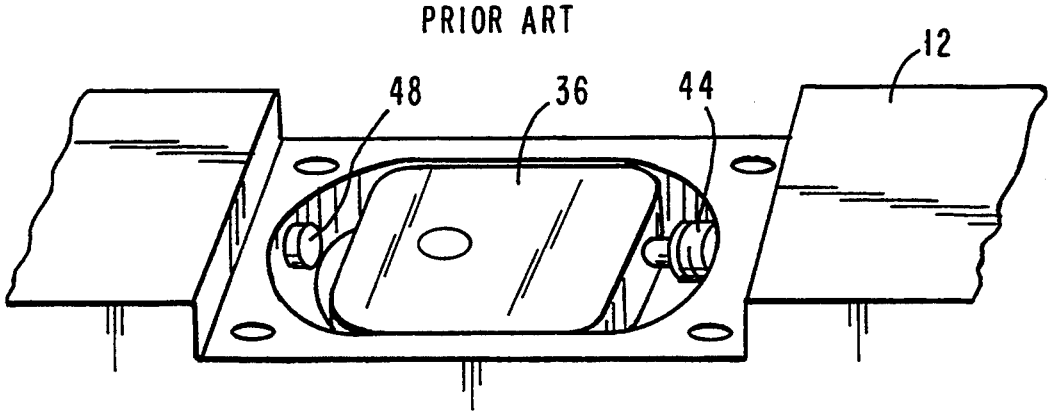
FIG. 3 PRIOR ART
FIGS. 3 and 4 illustrate other portions of the apparatus of U.S. Pat. No. 4,030,556, further showing why the problem of striker/bearing cocking occurs.
Figure 4:
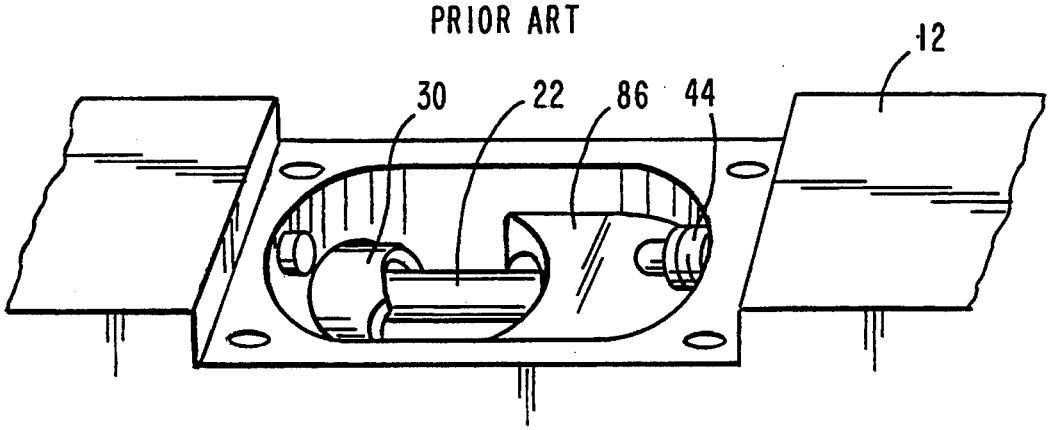
FIG. 4 PRIOR ART

FIGS. 3 and 4 schematically illustrate a portion of the impact tool of U.S. Pat. No. 4,030,556 (turned upside down) in the region of the striker 36. In FIG. 3, the cover plate 52 is removed to expose the striker 36 and a portion of the plunger 44. In FIG. 4, the same view is shown except that the striker 36 is also removed. FIG. 4 illustrates a design in which the striker 36 rests on a shelf 86. This helped to support the striker 36, but only along a portion of its length, which was discovered to be another cause for adverse striker movement.

Figure 5:
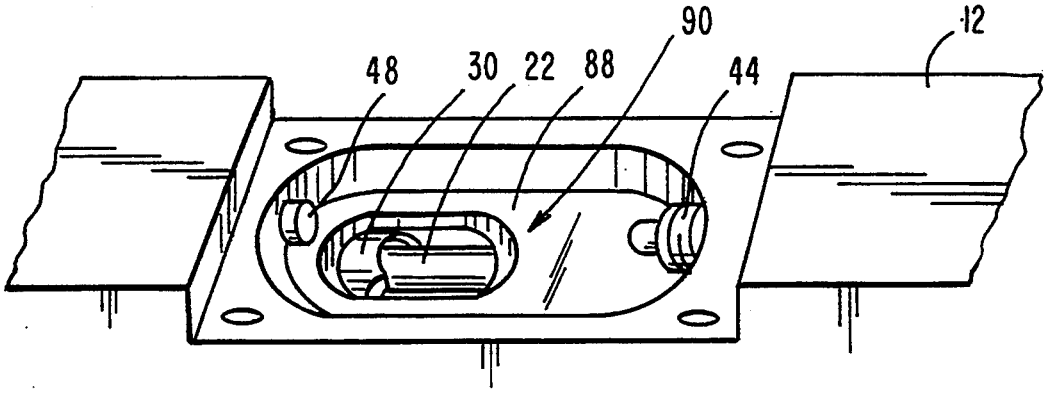
FIG. 5 illustrates a portion of the apparatus of FIG. 1, showing the new design in which the shelf area abutting the striker has been extended to provide additional support along its length.

In order to solve the problems illustrated with respect to FIGS. 2–4, a new shelf design is provided as shown in FIG. 5. In contrast with the shelf 86 of FIG. 4, the new shelf 88 has been extended at the sides and forward end and has an opening 90 which is only large enough to accommodate the back and forth movement of needle bearing 32. This provides support For the striker at its front and back, as well as along the sides, thereby preventing the striker from moving in a vertical direction transverse to its intended longitudinal movement—i.e., in a direction toward drive shaft 22.

Figure 6:
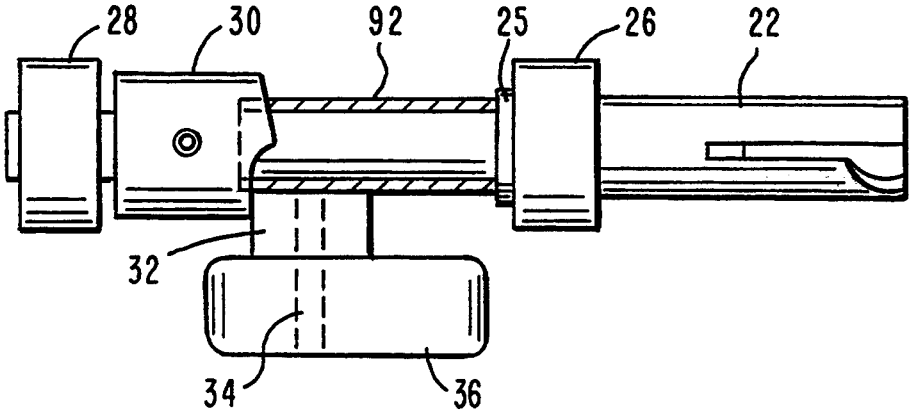
FIG. 6 is an illustration of a portion of the apparatus of this new impact tool, in which a sleeve bearing is located around the drive shaft in order to eliminate any wear of the drive shaft clue to bearing rise. This can be used in combination with the improvement illustrated in FIG. 5 to greatly minimize wear and to provide more efficient impact delivery to the cutting chisel.

FIG. 6 schematically illustrates another improvement which is used in combination with the improved shelf area design of FIG. 5 in order to minimize wear on drive shaft 22. Since manufacturing tolerances may still allow or cause the needle bearing 32 to occasionally rise, even if the extended shelf area of FIG. 5 is used, a bearing sleeve 92 is provided. Bearing sleeve 92 has a running fit on drive shaft 22 as shown, and will eliminate any wear due to bearing 32 "rise". Sleeve bearing 92 can be made of molybdenum filled nylon or other materials. Components such as cam 30, output shaft 48, striker 36 and drive shaft 22 are typically made of suitable steel, which may be appropriately heat treated as needed.

Figure 7:
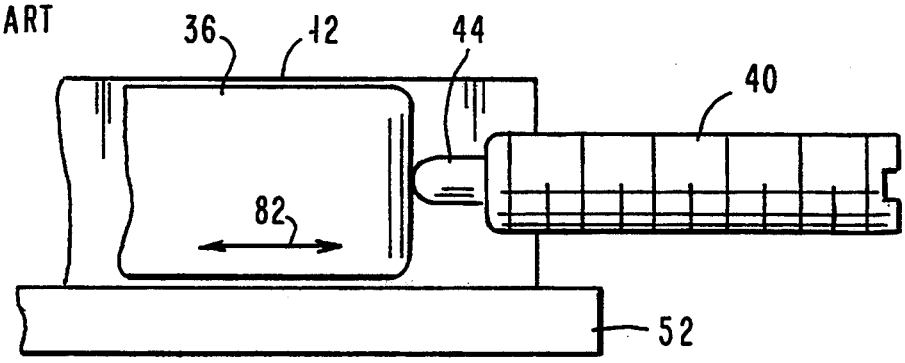
FIG. 7 PRIOR ART
FIG. 7 is an illustration of the striker/plunger assembly used in the impact tool design of U.S. Pat. No. 4,030,556.

FIG. 7 schematically illustrates another portion of the miniature impact tool of U.S. Pat. No. 4,030,556, and specifically the striker and spring plunger assembly. This is a partial side view showing the cover plate 52, striker 36, and spring-driven plunger 44. The intended movement of striker 36 is in the directions indicated by arrow 82. It was discovered that, in this design, the striker 36 can rub against the covet plate 52 and the inner surfaces of housing 12 either constantly or alternately during each cycle of tool operation.

Figure 8:
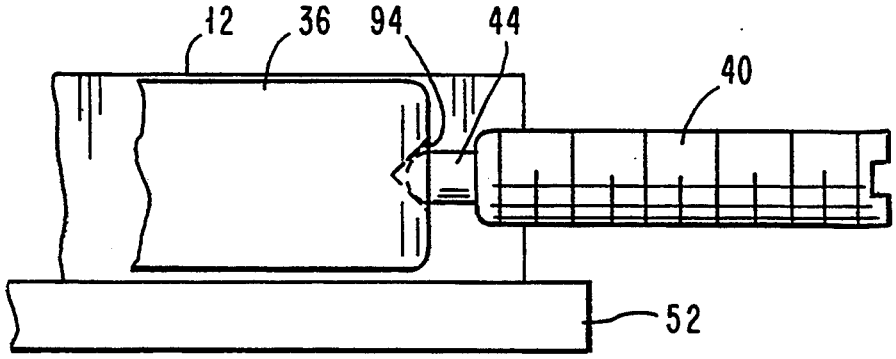
FIG. 8 is a schematic illustration of the improved design of the present invention in which the striker contains a guide means such as a groove or recess into which the nose of the spring plunger fits in order to provide more controlled motion of the striker for minimizing friction with the adjacent surfaces.

The new design of FIG. 8 uses a guide means to eliminate much of the errant motion of striker 36 to thereby minimize friction with the surrounding surfaces. In a particular embodiment, the striker has a depression or recess 94 into which the tip or nose of the spring-driven plunger 44 fits. Recess 94 can be of a generally conical shape and is so located that the rear end of the striker is suspended between the inner surfaces of the cover plate 52 and the housing 12, and also between the side surfaces (not shown) of the striker cavity. This reduces friction during movement of the striker and therefore increases the impact of the striker against the tool holder 48, making the tool more efficient.

In general, recess 94 has a shape designed to accommodate the shape of the nose of the plunger 44 in order to minimize both up-and-down and side-to-side motion of the striker. For most plungers which have a generally conical or rounded nose shape, a conical depression works well. As an alternative to a recess, a hollow cylindrical plunger guide can extend outwardly from the rear surface of striker 36. The tip or nose of the plunger 44 would enter this guide structure to provide alignment of the plunger and striker.

Figure 9:
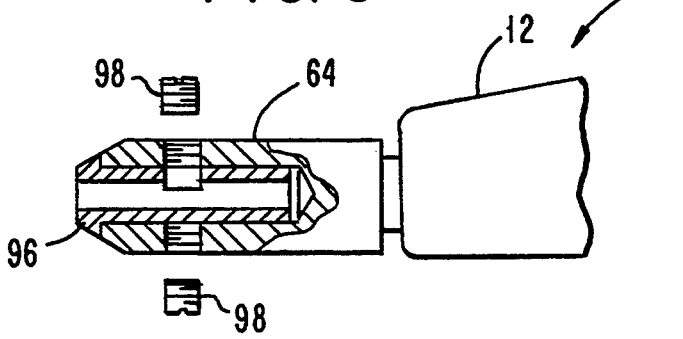
FIG. 9 shows the chisel-holding end of this new impact tool, where the output shaft of the tool includes a flanged portion into which a collet can be inserted.

FIG. 9 is an illustration of the fore end of the tool of FIG. 1, where the cylindrical portion 64 of the output shaft 48 has been modified to accept a collet 96. Collet 96 is held within the output shaft 48 by set screw 98. By providing a design in which different types of collets 96 can be secured in output shaft 48, tool 10 can accommodate chisels having different shank geometries.

Figure 10:
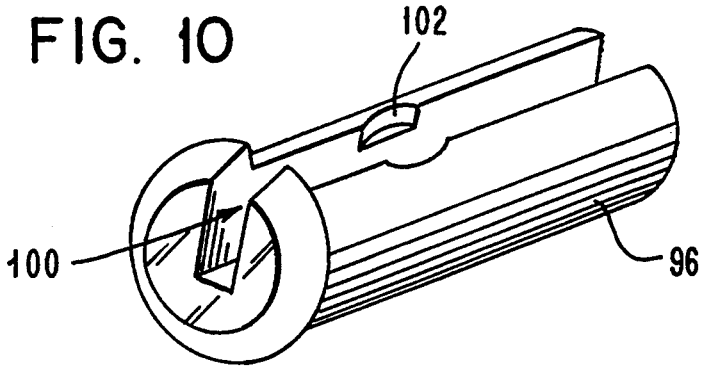

FIG. 10 illustrates a collet 96 having a rectangular slot 100 for accommodating chisel shanks of rectangular shape. A recess 102 is provided as needed for clearance of the set screw 98.

Figure 11A:
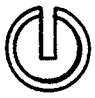
FIGS. 11A–11E illustrate other types of collets that can be used in this impact tool.
Figure 11B:
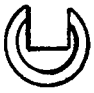
Figure 11C:
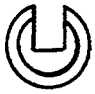
Figure 11D:
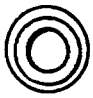
Figure 11E:
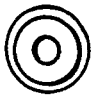

FIGS. 11A–11E show the fronts of various types of collets that can be used in the output sleeve 64 of this tool. The collets of FIGS. 11A and 11C are used for rectangular shaped chisel shanks, while the collet of FIG. 11B will accommodate a square shank. The collets of FIGS. 11D and 11E will accommodate chisel shanks having circular cross sections.

The miniature impact tool of the present design can be hand-held and is of light weight. The improvements made to the tool of U.S. Pat. No. 4,030,566 do not increase its complexity or weight, but do correct potential problems which have been detected only after years of use.

While the invention has been described with respect to particular embodiments thereof, it will be apparent to those of skill in the art that variations may be made consistent with the gist and scope of the present invention. For example, it may be possible to modify cam 30 so that it bears against needle bearing 32 more close to the centerline point. Notwithstanding the illustrations and description provided herein, the invention is to be limited only by the claims issuing thereon.

I claim:

1. An impact tool comprising:

rotary means adapted for being driven in a rotary motion, said rotary means including a drive shaft that is biased in a forward direction by a spring means and a cam attached to said drive shaft, linear reciprocating means abutting said rotary means for converting said rotary motion to a linear motion, said linear reciprocating means including a bearing having a surface in contact with said cam, said bearing being moved in a backward longitudinal direction as said cam rotates, an output shaft having at one end thereof an aperture for holding a cutting chisel, means for preventing rotation of said output shaft, a housing enclosing said rotary means, said output shaft and said linear reciprocating means, a striker that is movable in a backward longitudinal direction by the action of said cam and a plunger/-spring assembly including a plunger and a spring where said plunger is in contact with said striker and causes said striker to move in a forward longitudinal direction for providing an impact force to said output shaft, said housing having a shelf means for substantially preventing the movement of said striker in a direction transverse to its longitudinal motion when striking said output shaft and recoiling therefrom, said striker having a guide means at a striker surface that is contacted by said plunger, at least a portion of said plunger being located in said guide means during longitudinal movement of said striker, and isolation means for suspending said output shaft longitudinally including elastomeric rings encircling and abutting said output shaft.

2. The impact tool of claim 1, further including a sleeve bearing enclosing a substantial portion of said drive shaft.

3. The impact tool of claim 2, where said striker is connected to said bearing and moves in a longitudinal direction toward said plunger/spring assembly as said bearing moves in that direction.

4. The impact tool of claim 3, wherein said plunger/-spring assembly includes:

a hollow cylindrical body positioned within said housing, a plunger positioned within said body having one end thereof abutment with said striker;

a spring in abutment with said plunger, and a spring retainer means in contact with said spring for adjusting spring tension.

5. The impact tool of claim 1, wherein said output shaft further includes an aperture in which is located a removable collet for holding said cutting tool.

6. A miniature impact tool comprising:

rotary means adapted for being driven in a rotary motion, said rotary means including a drive shaft adapted to be driven in a rotary motion, a cam connected to said drive shaft and a sleeve bearing having a sliding fit contact to said drive shaft, linear reciprocating means for converting said rotary motion to linear longitudinal motion, said linear reciprocating means including a cam follower abutting said cam;

a striker connected to said cam follower where a forward surface of said striker abuts a tool holder, and a spring plunger assembly abutting a rear surface of said striker, a tool holder for holding a chisel, said tool holder being struck by said striker during said lineal longitudinal motion to cause said chisel to impact a workpiece against which it is held, a housing enclosing said rotary means, said linear reciprocating means and a portion of said tool holder, means adjacent another surface of said striker for limiting substantial movement of said striker in a direction toward said drive shaft wherein said striker has a guide means on said rear surface thereof which is in abutment with a plunger, said plunger being in contact with said guide means during forward longitudinal movement of said striker toward said tool holder.

7. The miniature impact tool of claim 6, where said tool holder includes removable collet means for accommodating cutting tools of different shank size and shape.

8. The miniature impact tool of claim 6, where said cam follower further includes a bearing assembly abutting said cam and a pin connecting said bearing assembly and said striker.

9. The miniature impact tool of claim 8, where said tool holder is a generally cylindrical shaft, there being elastomeric cushioning rings encircling and abutting a portion of said tool holder.

10. The miniature impact tool of claim 9, further including means for preventing rotation of said tool holder, and bias means for biasing said drive shaft in a forward longitudinal direction.

* * * * *